United States Patent [19]

Altman et al.

[11] Patent Number: 4,533,364

[45] Date of Patent: Aug. 6, 1985

[54] METHOD FOR FLUE GAS CONDITIONING WITH THE DECOMPOSITION PRODUCTS OF AMMONIUM SULFATE OR AMMONIUM BISULFATE

[75] Inventors: Ralph F. Altman, Chattanooga, Tenn.; John P. Gooch, Birmingham, Ala.; Edward B. Dismukes, Birmingham, Ala.; Roy E. Bickelhaupt, Birmingham, Ala.; Robert S. Dahlin, Birmingham, Ala.

[73] Assignee: Electric Power Research Institute, Inc., Palo Alto, Calif.

[21] Appl. No.: 462,754

[22] Filed: Feb. 1, 1983

[51] Int. Cl.[3] ..... B03C 1/00

[52] U.S. Cl. ..... 55/5; 423/215.5; 423/541 A

[58] Field of Search ..... 55/5, 10; 423/215.5, 423/541 A

[56] References Cited

U.S. PATENT DOCUMENTS

| | | | |
|---|---|---|---|
| 3,581,463 | 6/1971 | Roberts | 55/5 |
| 3,665,676 | 5/1972 | McKewen | 55/10 |
| 4,042,348 | 8/1977 | Bennett et al. | 55/5 |
| 4,043,768 | 8/1977 | Bennett et al. | 55/5 |
| 4,146,579 | 3/1979 | Dezael et al. | 423/541 A |
| 4,300,920 | 11/1981 | Grove | 55/312 |

OTHER PUBLICATIONS

Lowe, H. J., "Reduction of Emission of Pollutants, Recent Advances in Electrostatic Precipitators for Dust Removal", *Phil. Trans. Roy. Soc. Lond. A. 265*, 301–307 (1969).

*Chemical Abstracts*, 75, 121047c, "Increase in the Operating Efficiency of Electrostatic Precipitators" (1971).

Dalmon, J. and Tidy, D., "A Comparison of Chemical Additives as Aids to the Electrostatic Precipitation of Fly-Ash", *Atmospheric Environment 6*, 721–734 (1972).

Dismukes, Edward B., "Conditioning of Fly Ash with Sulfamic Acid, Ammonium Sulfate, and Ammonium Bisulfate", *Environmental Protection Technology Series*, EPA-650/2-74-114 (1974).

Tu, K. W. and Kanapilly, G. M., "Generation and Characterization of Submicron Ammonium Sulfate and Ammonium Hydrogen Sulfate Aerosols", *Atmospheric Environment 12*, 1623–1629 (1978).

Spafford, Dismukes and Dillon, "Analysis of Thermal Decomposition Products of Flue Gas Conditioning Agents", EPA-600/7-79-179 (1979).

Oglesby, Jr., S. and Nichols, G. B., *Electrostatic Precipitation*, Dekker, 1978, pp. 119–155.

*Primary Examiner*—Bernard Nozick

*Attorney, Agent, or Firm*—Flehr, Hohbach, Test, Albritton & Herbert

[57] ABSTRACT

A method is provided for enhancing the efficiency of fly ash collection in an electrostatic precipitator by lowering the resistivity of the fly ash particles in the flue gas, comprising the steps of introducing an aqueous solution of ammonium sulfate or ammonium bisulfate into a slipstream of hot gas in a chamber external to the main flue gas duct wherein thermal decomposition is effected and distributing the decomposition products into the main flue gas stream exiting from the air preheater at a point upstream from the electrostatic precipitator.

8 Claims, 2 Drawing Figures

METHOD FOR FLUE GAS CONDITIONING WITH THE DECOMPOSITION PRODUCTS OF AMMONIUM SULFATE OR AMMONIUM BISULFATE

The present invention relates generally to a method for improving the efficiency of fly ash collection in an electrostatic precipitator located on the cold side of the air preheater (cold side precipitator) operating on flue gas from a coal-burning boiler. More specifically, the invention relates to a method for decreasing the electrical resistivity of the fly ash by treatment of the ash with the thermal decomposition products of an aqueous solution of ammonium sulfate or ammonium bisulfate.

An electrostatic precipitator is an apparatus used to remove fly ash particles from flue gas in order to reduce atmospheric pollution. The precipitator utilizes a corona discharge to electrically charge the fly ash particles, which are then attracted to a grounded collecting plate. The performance of the precipitator is in part dependent upon the electrical resistivity of the fly ash particles; the performance is most efficient when the resistivity is in the approximate range of $10^9$ to $10^{10}$ ohm cm. If the resistivity is too high, current flow through the precipitated ash layer on the plate establishes corona in the ash layer, which is detrimental to the precipitation process. Precipitation is impeded by this additional corona (termed "back corona") because the fly ash particles are subjected to bipolar charging at a diminished electric field in the interelectrode space. On the other hand, if the resistivity is too low, the particles collected on the plate lose their charge rapidly and are difficult to retain on the plate. As a result, they tend to be reentrained in the flue gas. When a favorable resistivity is achieved, the problems of back corona and reentrainment are alleviated and there is a resultant increase in the precipitation efficiency.

It is known that the interaction of fly ash with sulfur trioxide enhances the performance of a cold side electrostatic precipitator by lowering the resistivity of the ash particles. Various methods are known for providing sulfur trioxide to flue gas. For example, sulfur trioxide has been provided to the flue gas upstream of the precipitator by converting sulfur dioxide contained in the flue gas to sulfur trioxide (by means of a catalytic oxidation with oxygen or direct oxidation with ozone), by converting sulfur dioxide from an external source to sulfur trioxide by means of catalytic oxidation with oxygen and introducing the sulfur trioxide into the flue gas, by the addition of the decomposition products of sulfuric acid (water vapor and sulfur trioxide), and by the addition of the vapor of sulfuric acid.

One disadvantage of the known methods is that the system for catalytic oxidation of sulfur dioxide to sulfur trioxide has a much higher capital cost than the system required for the present invention. The method which employs sulfuric acid as a conditioning agent is undesirable because sulfuric acid is highly corrosive.

Still other processes for providing sulfur trioxide to flue gas to enhance electrostatic precipitation involve the addition of sulfur trioxide to the flue gas in combination with ammonia and water, specifically as the decomposition products of the compound ammonium sulfate or ammonium bisulfate. U.S. Pat. No. 3,665,676 describes the addition of a finely divided powder or an aqueous solution of ammonium sulfate or ammonium bisulfate to flue gas upstream from a precipitator and downstream from an air preheater at a temperature in the 240° F. to 800° F. range. A disadvantage of this method is that at this point of injection the upper limit of the temperature range will rarely exceed 400° F., and as a result, the thermal decomposition of the added chemical to produce sulfur trioxide will be minimal. The added ammonium sulfate may not be decomposed much further than the products ammonia and ammonium bisulfate and the added ammonium bisulfate may not be appreciably decomposed at all. With sulfur trioxide remaining in a chemically combined form (ammonium sulfate or ammonium bisulfate), it is less satisfactory than that of the equivalent amount introduced as gaseous decomposition products because either it is required in a greater amount for a given resistivity change or it imparts an undesirable sticky quality to the ash.

U.S. Pat. Nos. 4,042,348 and 4,043,768 describe methods involving the addition of an aqueous solution of ammonium bisulfate (U.S. Pat. No. 4,042,348) or ammonium sulfate (U.S. Pat. No. 4,043,768) to the flue gas at a point upstream from the air preheater, where the temperature is between 1094° F. (590° C.) and 1652° F. (900° C.) but preferably not above 1382° F. (750° C.). While U.S. Pat. Nos. 4,042,348 and 4,043,768 disclose that the temperature range of 590° C. to 900° C. is sufficient to bring about the volatilization of the chemicals, which may avoid air preheater pluggage, it is evident that to the degree that gaseous ammonia, water, and sulfur trioxide are produced in the volatilization process, recombination to ammonium bisulfate or ammonium sulfate may still ensue and result in air preheater pluggage.

The present invention provides a method which is advantageous over the prior art methods by the steps of decomposing ammonium sulfate or ammonium bisulfate in a slipstream of hot flue gas or hot combustion air in a chamber external to the main flue gas duct, where the temperature of the hot flue gas or air is in the range of 600° F. to 1000° F., and then injecting the decomposition products into the main flue gas duct at a point between the air preheater and the precipitator.

It is therefore, an object of the present invention to provide an improved method of lowering the resistivity of fly ash particles with aqueous ammonium sulfate or ammonium bisulfate solutions. Another object of the present invention is to provide a system that is mechanically simple, and therefore reliable. Another object of the present invention is to provide a system with a lower capital cost than the system used in the catalytic oxidation of sulfur dioxide to sulfur trioxide. Another object of the present invention is to eliminate air preheater pluggage by injecting the decomposition products downstream from the air preheater. A further object of the present invention is to achieve maximum benefit from the ammonium sulfate or ammonium bisulfate by decomposing the compound in an external chamber where the temperature is high enough to ensure a substantial degree of decomposition.

FIG. 1 represents the method of decomposing ammonium sulfate or ammonium bisulfate with a slipstream of hot flue gas.

FIG. 2 represents the method of decomposing ammonium sulfate or ammonium bisulfate with a slipstream of hot combustion air.

Figure 1:
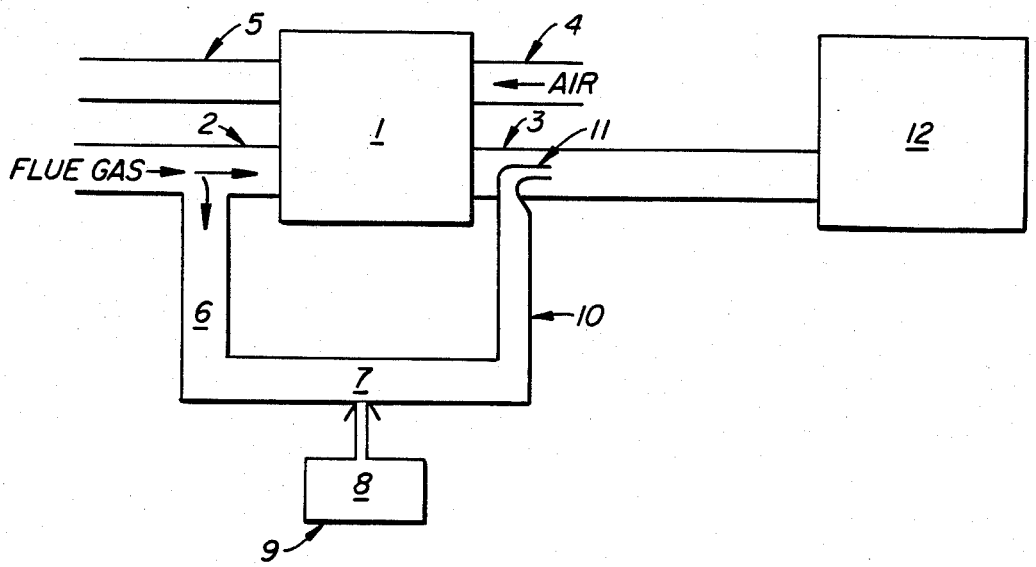
FIGS. 1 and 2 are illustrations of two preferred embodiments of the present invention.

In accordance with the present invention, there is provided a method comprising the steps of introducing an aqueous solution of ammonium sulfate or ammonium bisulfate [hereinafter sometimes referred to as the conditioning agent] into a slipstream of hot gas in a chamber external to the main flue gas ducts wherein thermal decomposition is effected and distributing the decomposition products into the main stream of flue gas exiting from the air preheater at a point upstream from the electrostatic precipitator.

Preferably, thermal decomposition is effected by spraying an aqueous solution of ammonium sulfate or ammonium bisulfate into a chamber external to the main flue gas ducts through which a slipstream of hot flue gas or hot combustion air is flowing. The decomposition products are then transported through a heated or thermally insulated duct to a distribution manifold and distributed into the main stream of flue gas exiting from the air preheater at a point upstream from the electrostatic precipitator.

The temperature of the flue gas or air should be in the range from about 600° F. to 1000° F. It is particularly preferred if the flue gas temperature is in the range of 700° F. to 1000° F. In this temperature range, with reaction times of 2 seconds or less, there is adequate conversion of the conditioning agent to the key decomposition product, sulfur trioxide.

The preferred aqueous solution of ammonium sulfate contains from about 5 to 45% by weight ammonium sulfate and the preferred aqueous solution of ammonium bisulfate contains from about 5 to 80% by weight ammonium bisulfate. Preferably, the aqueous solution of ammonium sulfate or ammonium bisulfate is sprayed into the chamber at a rate sufficient to produce a sulfur trioxide concentration from about 250 to 2500 ppm by volume. The sulfur trioxide should be distributed into the main stream of flue gas to achieve a preferred concentration of from about 2.5 to 25 ppm by volume.

The present invention is applicable to any situation in which the operation of a cold side precipitator is being adversely affected by the high resistivity of the fly ash it is collecting. In particular, the present invention will be useful in situations where a utility switches from high sulfur coal to low sulfur coal in order to comply with sulfur oxide emissions limitations. Low sulfur coals generally produce fly ash that is characterized by high resistivity at cold side precipitator temperatures.

The present invention will also be useful (1) in circumstances where there is a switch in coal supplies and the new coal produces fly ash with higher resistivity; (2) in circumstances where the performance of an existing precipitator must be optimized, by lowering the resistivity of the fly ash, in order to meet new particulate emissions regulations; and (3) in circumstances where a new unit is scheduled to burn a low sulfur coal, because the cost of the new precipitator can be reduced by redesigning the existing precipitator to collect fly ash with a lower resistivity.

Referring to FIG. 1, there is illustrated an air preheater 1 with an inlet duct 2 on the hot side and an outlet duct 3 on the cold side for flue gas, as well as an inlet duct 4 on the cold side and an outlet duct 5 on the hot side for combustion air. A slipstream of flue gas 6 is drawn from the main flue gas stream on the hot side of the air preheater and then drawn through the chamber 7. An aqueous solution of conditioning agent 8 is contained in the reservoir 9 and sprayed into the chamber 7. The hot gas flowing through chamber 7 is at a temperature in the range from about 600° F. to 1000° F., and at approximately atmospheric pressure. The hot gas in chamber 7 decomposes the conditioning agent, and the decomposition products—gaseous ammonia, water, and sulfur trioxide are transported through the heated or insulated duct 10, where they are distributed through the distribution manifold 11 into the main stream of flue gas exiting from the air preheater at a point downstream from the air preheater 1 and upstream from the electrostatic precipitator 12.

Figure 2:
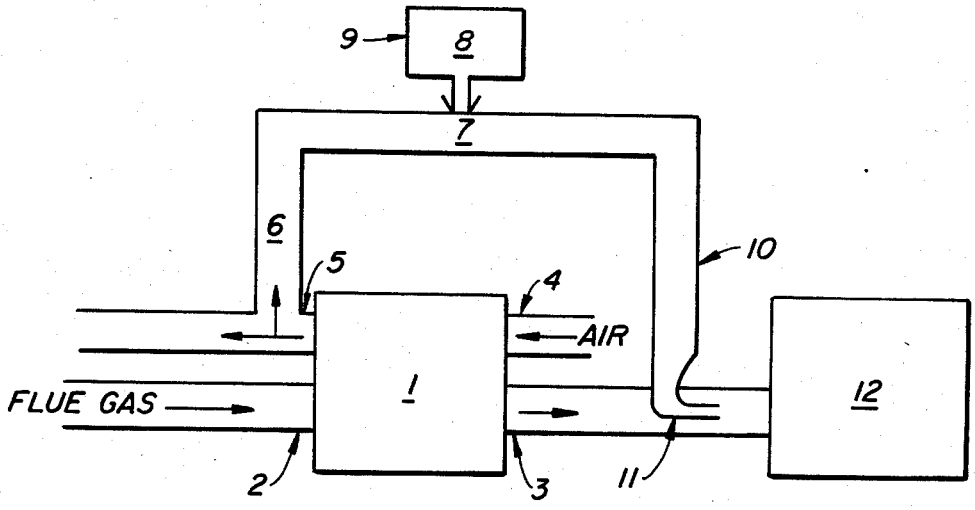

Referring to FIG. 2, there is illustrated an air preheater 1 with an inlet duct 2 on the hot side and an outlet duct 3 on the cold side for flue gas, as well as an inlet duct 4 on the cold side and an outlet duct 5 on the hot side for combustion air. A slipstream of the combustion air 6 is drawn from the main combustion air stream on the hot side of the air preheater and then drawn through chamber 7. An aqueous solution of conditioning agent 8 is contained in the reservoir 9 and sprayed into the chamber 7. The hot air flowing through the chamber 7 is at a temperature in the range of from about 600° F. to 1000° F., and is at approximately atmospheric pressure. The hot air in chamber 7 decomposes the conditioning agent, and the decomposition products—gaseous ammonia, water, and sulfur trioxide—are transported through the heated or insulated duct 10, where they are distributed through the distribution manifold 11 into the main stream of flue gas exiting from the air preheater at a point downstream from the air preheater 1 and upstream from the electrostatic precipitator 12.

EXAMPLE 1

A tubular apparatus of Pyrex was constructed for a laboratory investigation of the decomposition of ammonium sulfate. A stream of simulated flue gas was passed through this apparatus and maintained at a constant temperature selected from the range of 500° F. to 900° F.; the flow rate of the gas stream was adjusted to provide a residence time of about 2 seconds in the heated zone. A 40% aqueous solution was sprayed into the heated zone near the inlet at a rate sufficient to produce 2000 ppm by volume of gaseous ammonia and 1000 ppm by volume of gaseous water and sulfur trioxide each. From a point near the outlet of the heated zone a sample stream is drawn off and analyzed for (1) ammonium sulfate that had not decomposed, (2) the expected decomposition products (ammonia and sulfur trioxide), and (3) one possible additional but undesired decomposition product, sulfur dioxide. The results of analyses in experiments performed at 700° F. or 900° F. signified that virtually complete decomposition occurred to produce the desired products: ammonia, water, and sulfur trioxide. From the yield of sulfur trioxide, a minimum of 80% of the ammonium sulfate was estimated to be decomposed by the desired mechanism in 2 seconds of reaction time. The yield of the undesired product, sulfur dioxide, was negligible.

At a temperature of 600° F., at least 4% of the ammonium sulfate decomposed to produce trioxide in 2 seconds of reaction time. At a reduced temperature of 500° F., the yeild of sulfur trioxide was negligible. At both reduced temperatures, however, the yield of sulfur dioxide by a competitive decomposition process continued to be negligible.

EXAMPLE 2

A tubular apparatus larger than that used in Example 1 made of stainless steel was fabricated for demonstration of the conditioning process on a pilot scale. This apparatus was designed to provide for the decomposition of ammonium sulfate or ammonium bisulfate in a slipstream of air or flue gas flowing at a nominal rate of about 35 standard cubic feet per minute and for the subsequent injection of the decomposition products into a stream of flue gas flowing at a nominal rate of 2500 standard cubic feet per minute. The main gas stream was produced by the combustion of a low sulfur Western coal. This stream passed through a pilot scale electrostatic precipitator at an actual temperature of about 300° F.

Ammonium sulfate was sprayed into the slipstream of air as an aqueous solution containing either 10 or 20% by weight of the conditioning agent, with the air at a temperature of about 900° F. at the point of ammonium sulfate addition. The rate of ammonium sulfate addition was sufficient to produce a concentration of 10 to 20 ppm by volume of sulfur trioxide in the main gas stream.

The results of measurements to determine the efficacy of the conditioning process, by comparing data obtained with and without the addition of ammonium sulfate, are as follows:

1. Samples of fly ash particulate were collected isokenetically from the main gas stream beyond the point of mixing with the treated slipstream but ahead of the electrostatic precipitator. Analysis of this material showed an increase in the sulfate content of the ash that was consistent with the rate of ammonium sulfate addition.

2. Samples of flue gas were collected at the point referred to in Item 1. The concentration of sulfur trioxide gas (or, more appropriately at 300° F., sulfuric acid vapor) was negligible with or without ammonium sulfate addition, signifying uptake of virtually all of the available sulfur trioxide, whether it occurred naturally from the combustion of coal or artifically from the treatment with ammonium sulfate.

3. Samples of fly ash particulate were collected at the point referred to in Item 1, and their electrical resistivities were measured. Addition of ammonium sulfate lowered the resistivity typically from $2\times10^{11}$ ohm cm to $2\times10^{10}$ ohm cm.

4. Electrical characteristics of the electrostatic precipitator were determined. Plots of current density versus applied voltage showed that back corona (an indication of high resistivity) existed without ammonium sulfate addition but that this phenomenon disappeared when the conditioning agent was added. The electrical effects of ammonium sulfate were in the direction and of a magnitude that would afford marked improvement in precipitator performance.

EXAMPLE 3

An aqueous solution containing ammonium bisulfate was used in place of ammonium sulfate in the type of pilot scale testing described in Example 2. The results achieved were similar to those given in Example 2.

What is claimed is:

1. A method for conditioning flue gas containing suspended fly ash, comprising the steps of:

a. diverting a slipstream of flue gas from a main flue gas stream at a point upstream from an air preheater located directly upstream of an electrostatic precipitator where the temperature of said main flue gas stream is in the range of about 700° F. to 1000° F., said diverted stream thereby having a temperature in the range of from about 700° F. to 1000° F.;

b. introducing an aqueous solution of an ammonium salt selected from the group consisting of ammonium sulfate and ammonium bisulfate into said diverted flue gas slipstream thereby effecting thermal decomposition of said ammonium salt into its gaseous thermal decomposition products which include sulfur trioxide and ammonia; and c. returning said diverted flue gas slipstream to said main flue gas stream at a point between said air preheater and said electrostatic precipitator thereby distributing said gaseous thermal decomposition products into said main flue gas stream flowing between said air preheater and said electrostatic precipitator.

2. A method for conditioning flue gas containing suspended fly ash, comprising the steps of:

a. diverting a slipstream of combustion air from a main combustion air stream exiting the upstream side of an air preheater after having passed through said preheater where the temperature of said main combustion air stream is in the range of about 700° F. to 1000° F., said diverted combustion air slipstream thereby having a temperature in the range of from about 700° F. to 1000° F.;

b. introducing an aqueous solution of an ammonium salt selected from the group consisting of ammonium sulfate and ammonium bisulfate into said diverted slipstream of combustion air, thereby effecting thermal decomposition of said ammonium salt into its gaseous thermal decomposition products which includes sulfur trioxide and ammonia; and c. introducing said diverted slipstream of combustion air into a main flue gas stream at a point between said air preheater and an electrostatic precipitator located directly downstream of said air preheater, thereby distributing said gaseous thermal decomposition products into said main flue gas stream between said air preheater and said electrostatic precipitator.

3. A method according to claim 1 or 2 wherein said decomposition products from step (b) are transported through a heated duct.

4. A method according to claim 1 or 2 wherein said decomposition products from step (b) are transported through a thermally insulated duct.

5. A method according to claim 1 or 2 wherein said decomposition products are distributed into said main flue gas stream through a distribution manifold.

6. A method according to claim 1 or 2 wherein the aqueous solution of ammonium sulfate contains from about 5 to 45% by weight of ammonium sulfate.

7. A method according to claim 1 or 2 wherein the aqueous solution of ammonium bisulfate contains from about 5 to 80% by weight of ammonium bisulfate.

8. A method according to claim 1 or 2 wherein said aqueous salt solution is sprayed at a rate sufficient to produce a sulfur trioxide concentration from about 250 to 2500 ppm by volume and said sulfur trioxide is then distributed into the main stream of flue gas to produce a concentration therein from about 2.5 to 25 ppm by volume.

* * * * *